United States Patent [19]

Kawakami et al.

[11] Patent Number: 4,768,003

[45] Date of Patent: Aug. 30, 1988

[54] MICROWAVE FILTER

[75] Inventors: Izumi Kawakami; Tomokazu Komazaki; Katuhiko Gunzi; Norio Onisi, all of Tokyo, Japan

[73] Assignee: OKI Electric Industry Co., Inc., Tokyo, Japan

[21] Appl. No.: 74,640

[22] Filed: Jul. 17, 1987

Related U.S. Application Data

[63] Continuation-in-part of Ser. No. 780,649, Sep. 26, 1985, abandoned.

[30] Foreign Application Priority Data

Sep. 28, 1984 [JP] Japan ..... 59-201455
Oct. 2, 1984 [JP] Japan ..... 59-205616

[51] Int. Cl.[4] ..... H01P 1/202; H01P 1/208; H01P 7/04

[52] U.S. Cl. ..... 333/202; 333/206; 333/207; 333/222; 333/223

[58] Field of Search ..... 333/202, 203, 206, 207, 333/245, 246, 219, 222, 223, 235

[56] References Cited

U.S. PATENT DOCUMENTS

| | | | |
|---|---|---|---|
| 4,342,972 | 8/1982 | Nishikawa et al. | 333/206 |
| 4,386,328 | 5/1983 | Masuda et al. | 333/202 |
| 4,426,631 | 1/1984 | D'Avello et al. | 333/202 |
| 4,431,977 | 2/1984 | Sokola et al. | 333/206 |
| 4,450,421 | 5/1984 | Meguro et al. | 333/202 |
| 4,546,333 | 10/1985 | Fukasawa et al. | 333/203 X |

FOREIGN PATENT DOCUMENTS

| | | |
|---|---|---|
| 61-80901 | 4/1986 | Japan . |
| 61-84101 | 4/1986 | Japan . |

*Primary Examiner*—Marvin L. Nussbaum
*Attorney, Agent, or Firm*—Martin M. Novack

[57] ABSTRACT

A microwave filter comprising a rectangular ceramics block (30) having a plurality of elongated parallel holes (31–36) extending from the top surface to the bottom surface thereof. The holes are plated with conductive layers (37, 38), and flat conductive areas (39–44) coupled with the layers (37, 38) spatially disposed on the top surface of the dielectric block (30) surround opening ends of the holes (31–36). An input terminal and an output terminal are provided adjacent to the conductive areas (39, 44) at both the extreme sides of the dielectric block (30).

9 Claims, 6 Drawing Sheets

MICROWAVE FILTER

RELATED APPLICATION

This is a continuation-in-part of U.S. application Ser. No. 780,649, filed Sept. 26, 1985, now abandoned.

BACKGROUND OF THE INVENTION

The present invention relates to a microwave filter using a plurality of dielectric resonators, and more particularly to a microwave filter in which a plurality of resonators are formed in a single dielectric body.

A high frequency signal filter for the microwave band has been proposed which uses a dielectric resonator using dielectric material having a high permittivity. As is well known, a dielectric resonator has the following advantages.

(1) A dielectric resonator is small in size; a dielectric resonator having a size similar to a strip line resonator can be obtained.

(2) A dielectric resonator having an un-loaded Q whose value is approximately equal to that of a waveguide resonator can be obtained.

(3) The producing process of a dielectric resonator is simple as compared with that of a waveguide resonator.

On the contrary, a dielectric resonator has the disadvantage that is is difficult to obtain temperature characteristics required. However, recent progress of dielectric material engineering is solving this problem. Therefore, a filter having dielectric resonators will be increasingly utilized.

FIG. 1 is a plan view of a prior microwave filter using a plurality of dielectric resonators. On the opposite ends of a conductive rectangular case 19, there are provided an input terminal 11 to which an antenna 13 is connected and an output terminal 12 to which an antenna 14 is connected. Dielectric resonators 15–18 are spatially aligned between the antennas 13 and 14. Each of the resonators 15–18 is composed of a hollow cylindrical member made of dielectric material and a conductive rod which is inserted in the hollow member. One ends of the dielectric resonators thus configurated are secured to the bottom surface of the case 19. In order to obtain the desired filter response characteristics by using those dielectric resonators, the length (d) between the antennas 13, 14 and the dielectric resonators 15, 18, respectively is determined in accordance with the desired amount of the coupling therebetween. Likewise, the length between adjacent dielectric resonators is determined in accordance with the desired amount of the coupling therebetween. In this case, it will be understood that the amount of the coupling increases when the distance decreases, and the amount of the coupling decreases when the distance increases.

However, the prior microwave filter of FIG. 1 has the following disadvantages.

(1) Upon the assembling process of the filter, it is difficult to locate exactly the dielectric resonators on the bottom surface of the case in accordance with the design specification. A slight error in positioning the dielectric resonators brings about significant errors in the filter characteristics.

(2) In practice, it is difficult to secure the dielectric resonators on the bottom surface of the case.

(3) The production cost is high since the filter uses a plurality of individual dielectric resonators.

In order to overcome these disadvantages, the applicant has proposed another dielectric filter (see U.S. Pat. No. 4,386,328). This filter uses a plurality of dielectric resonators formed in a single dielectric block. FIG. 2 is a cross sectional view of a part of the filter shown in the above U.S. patent. In this figure, the reference numeral 20 is a rectangular block made of a dielectric material. The block 20 has through holes 21, 22 which are spatially disposed at a predetermined pitch (P) from each other. Each of the holes is covered with a conductive material. Then, each of the plated holes surrounded by the dielectric material acts as a dielectric resonator. Furthermore, the block 20 has a groove 23 disposed between adjacent plated holes 21 and 22. The groove 23 acts to transfer the electromagnetic wave resulting from the plated hole 21 to the plated hole 22, or vice versa. In other words, the groove 23 acts as an electromagnetic coupler between adjacent dielectric resonators. The amount of the coupling depends upon the size of the groove.

However, this type of the filter has the disadvantage that the producton cost is high and the production process is complicated, because the particular process for producing the groove in the dielectric block is required.

SUMMARY OF THE INVENTION

It is an object, therefore, of the present invention to overcome the disadvantages of a prior filter of FIG. 2 by providing a new and improved dielectric microwave filter.

It is also an object of the present invention to provide a new and improved microwave filter which is simple in structure and easy to adjust the characteristics of the filter.

The above and other objects are attained by a microwave filter comprising a rectangular dielectric block having a plurality of parallel holes extending from the top surface to the bottom surface thereof and being covered with a conductive material, and conductive flat areas spatially disposed on the top surface of the dielectric block to surround opening ends of the holes, each of the conductive areas being electrically coupled with the conductive material of a corresponding hole, two of the conductive areas at both the extreme sides of the dielectric block being adjacent to an input terminal and an output terminal of the filter.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 3:
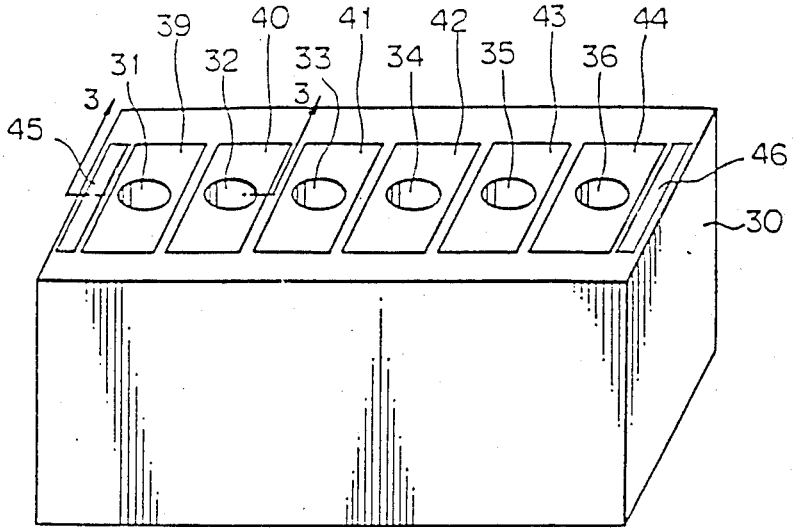
FIG. 3 is a perspective view of a microwave filter according to the present invention.
Figure 4:
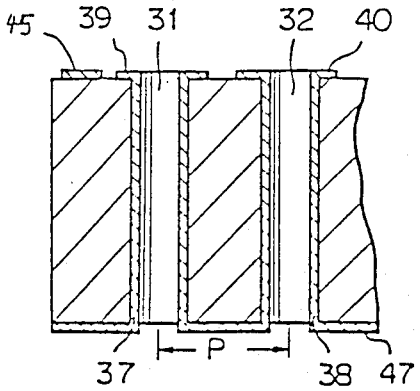
FIG. 4 is a cross sectional view of the microwave filter in FIG. 3 taken along lines 3—3.

FIG. 3 is a perspective view of a microwave filter embodying the present invention and FIG. 4 is a cross sectional view of the filter in FIG. 3 taken along lines 3—3. The microwave filter includes a rectangular block 30 which is made of a dielectric material such as ceramics. The block 30 has parallel six holes 31–36, which each extend from the top surface to the bottom surface of the block 30. These holes are spatially aligned. Further, the holes may be in cylindrical, square or rectangular shape. Each of the holes 31–36 is entirely covered with an electrically conductive material such as silver or copper as shown in FIG. 4, in which the holes 31 and 32 are covered with the conductive layers indicated by the reference numerals 37 and 38, respctively. The conductive material can be deposited on the surfaces of the holes by means of a printing manner or a plating manner. One hole covered with the conductive layers and surrounded by the dielectric material acts as one dielectric resonator. Of course, all the conductive layers in the holes are electrically coupled with one another by means of a conductive material 47 such as silver paste which is provided on the bottom surface of the block 30.

The block 30 also has electrically conductive flat areas 39–44, each of which is provided on the top surface of the block 30 so as to surround the opening end of the corresponding hole. The conductive areas 39–44 are electrically coupled with the conductive portions covering the holes 31–36, respectively. Preferably, each of the conductive areas 39–44 and the corresponding conductive portion are integrally formed. The conductive areas 39–44 shown in FIG. 3 have generally rectangular shaped pattern, and particularly the areas 39, 44 are adjacent to input and output terminals 45, 46 of the filter. The pattern of the conductive areas is not, however, limited to the rectangular shape, and any shape of the pattern can be selected. It should be noted that according to the present invention, an area between adjacent conductive areas acts as an electromagnetic coupler for coupling adjacent dielectric resonators. In other words, the present filter has no groove in the dielectric body for the electromagnetic coupler in the block 30.

To obtain the desired filter characteristics by utilizing the configuration of FIG. 3, the following matters must be considered.

(1) The resonance frequency of each dielectric resonator depends upon the height of the hole and the area of the conductive area associated with said hole. The height of the hole is around ¼ wavelength. Especially, it should be noted that the adjusting operation of the resonance frequency is facilitated, because the resonance frequency is adjustable by varying the area of the conductive area. This adjusting operation can be performed by trimming a part of the conductive area by means of a mechanical manner or an optical manner.

(2) The amount of the coupling (which can be expressed by a coupling coefficient) between adjacent dielectric resonators depends elementally upon the pitch (P) therebetween (FIG. 4) and additionally upon the area of the conductive areas relative to said adjacent dielectric resonators. It should be noted that the fine adjustment of the amount of the coupling is easily performed by trimming the area of adjacent conductive areas.

(3) The quality factor Q of the filter depends upon the number of dielectric resonators, or plated holes. The frequency characteristics becomes sharp as the number of the dielectric resonators increases. Therefore, although the filter of FIG. 3 has six plated holes, any number of plated holes can be selected.

In the filtering operation of the filter of FIG. 3, when an electical input signal is applied to the input terminal 45, the first dielectric resonator having the hole 31 generates the electromagnetic field. This electromagnetic field is transferred through the area between adjacent conductive areas 39 and 40 to the second dielectric resonator having the hole 32. In other words, the energy of the electromagnetic field resulting from the first dielectric resonator concentrates on the area between the conductive areas 39 and 40. The electromagnetic field transferred to the second resonator is then transferred through the area between the conductive areas 40 and 41 to the third dielectric resonator having the hole 33. In the same way, the electromagnetic field is transferred until the sixth dielectric resonator having the hole 36. Then, the energy of the electromagnetic field resulting from the sixth resonator is applied through the output terminal 46 to a load (not shown).

Figure 1:
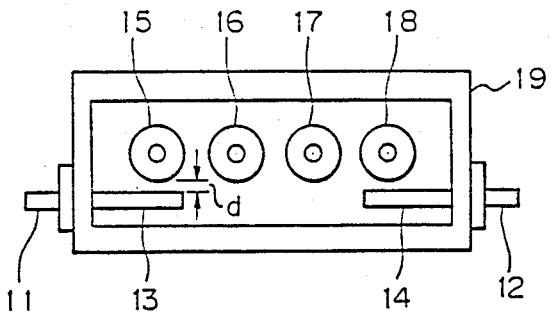
Fig. 1 PRIOR ART
FIG. 1 is a plan view of a prior microwave filter using a plurality of dielectric resonators.
Figure 2:
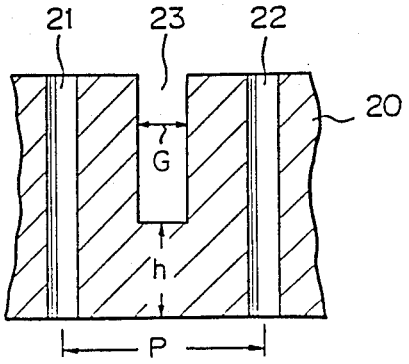
Fig. 2 PRIOR ART
FIG. 2 is a cross sectional view of a part of another prior microwave filter.

The description will be now given of experimental results of the filter of FIG. 3 in comparison with the filter of the conventional filter of FIG. 2.

Figure 5:
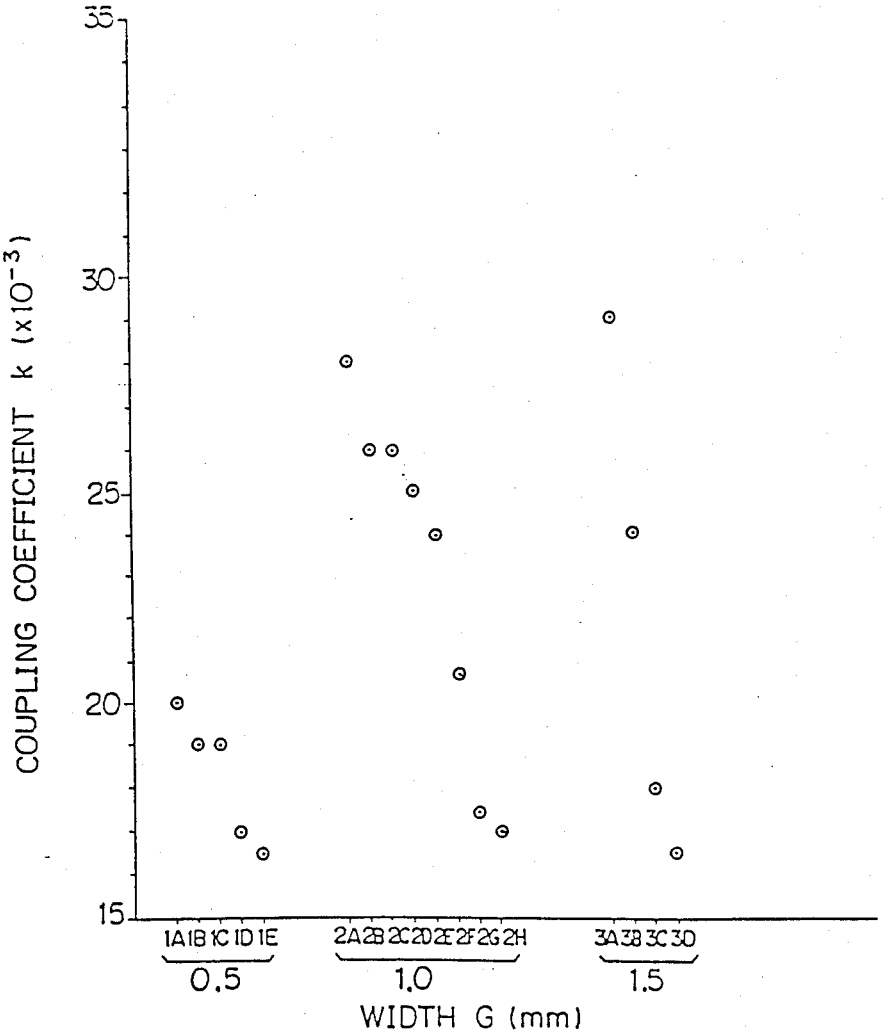
FIG. 5 shows the relationship between the coupling coefficient (K) and the width (G) of the groove in the filter of FIG. 2.

FIG. 5 shows the relationship between the coupling coefficient (K) between adjacent dielectric resonators and the width G of the groove of the filter of FIG. 2, when the numerical values shown in Table 1 are used.

TABLE 1

| SYMBOL | WIDTH "G" (mm) | PITCH "P" (mm) | THICKNESS "h" (mm) |
|---|---|---|---|
| 1A | 0.5 | 7.4 | 3.8 |
| 1B | 0.5 | 7.5 | 3.5 |
| 1C | 0.5 | 7.5 | 4.1 |
| 1D | 0.5 | 7.5 | 4.3 |
| 1E | 0.5 | 7.6 | 3.8 |
| 2A | 1.0 | 7.0 | 2.5 |
| 2B | 1.0 | 7.2 | 2.5 |
| 2C | 1.0 | 7.2 | 3.0 |
| 2D | 1.0 | 7.2 | 3.5 |
| 2E | 1.0 | 7.3 | 3.3 |
| 2F | 1.0 | 7.5 | 4.5 |
| 2G | 1.0 | 7.5 | 5.0 |
| 2H | 1.0 | 7.5 | 5.3 |
| 3A | 1.5 | 7.0 | 3.5 |
| 3B | 1.5 | 7.2 | 3.8 |
| 3C | 1.5 | 7.4 | 5.5 |
| 3D | 1.5 | 7.5 | 5.7 |

Figure 6:
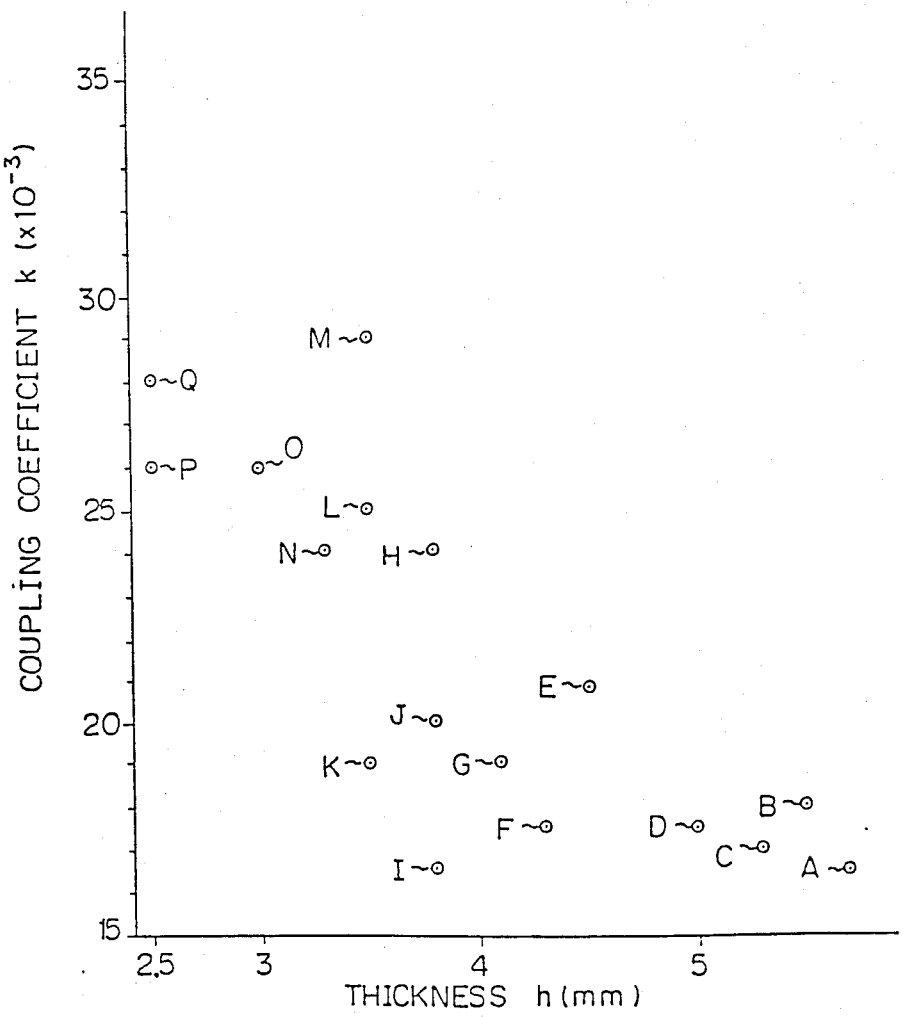
FIG. 6 shows the relationship between the coupling coefficient (K) and the thickness (h) between the bottom surface of the groove and the bottom surface of the dielectric block in the filter of FIG. 2.

FIG. 6 shows the relationship between the coupling coefficnent (K) and the thickness (h) of the filter of FIG. 2, when the numerical values shown in Table 2 are used.

TABLE 2

| SYMBOL | THICKNESS "h" (mm) | WIDTH "G" (mm) | PITCH "P" (mm) |
|---|---|---|---|
| A | 5.7 | 1.5 | 7.5 |

TABLE 2-continued

| SYMBOL | THICKNESS "h" (mm) | WIDTH "G" (mm) | PITCH "P" (mm) |
|---|---|---|---|
| B | 5.5 | 1.5 | 7.4 |
| C | 5.3 | 1.0 | 7.5 |
| D | 5.0 | 1.0 | 7.5 |
| E | 4.5 | 1.0 | 7.5 |
| F | 4.3 | 0.5 | 7.5 |
| G | 4.1 | 0.5 | 7.5 |
| H | 3.8 | 1.5 | 7.2 |
| I | 3.8 | 0.5 | 7.6 |
| J | 3.8 | 0.5 | 7.4 |
| K | 3.5 | 0.5 | 7.5 |
| L | 3.5 | 1.0 | 7.2 |
| M | 3.5 | 1.5 | 7.0 |
| N | 3.3 | 1.0 | 7.3 |
| O | 3.0 | 1.0 | 7.2 |
| P | 2.5 | 1.0 | 7.2 |
| Q | 2.5 | 1.0 | 7.0 |

Figure 7:
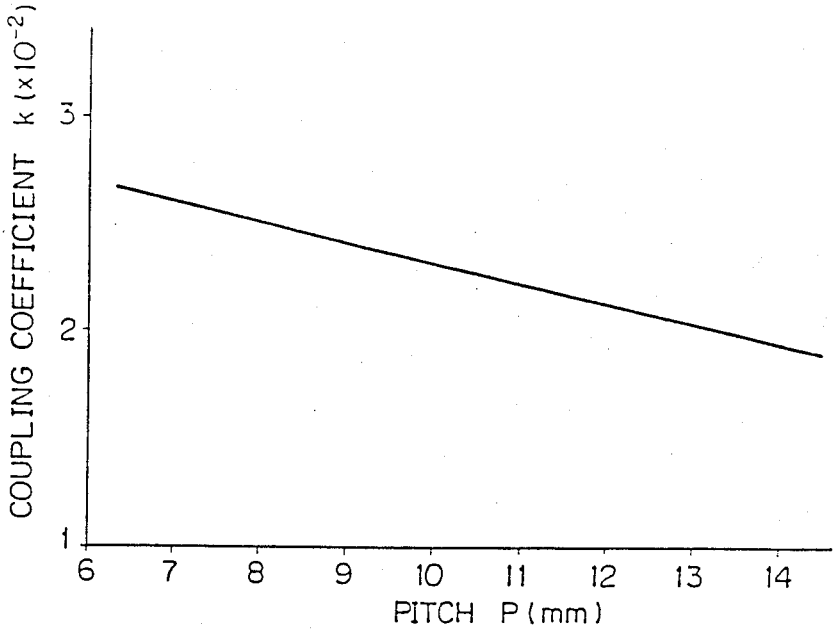
FIG. 7 shows the relationship between the coupling coefficient (K) and the pitch (P) in the filter of FIG. 3.

FIG. 7 shows the relationship between the coupling coefficient (K) and the pitch (P) between adjacent plated holes of the filter of FIG. 3.

It will be understood from FIGS. 5, 6 and 7 that similarly to the case of the prior filter, the filter of FIG. 3 can provide the coupling coefficient sufficient for obtaining the desired microwave filter characteristics. Of course, this coupling coefficient is finely adjustable by trimming the area of the conductive areas on the block 30.

For instance, to obtain the bandpass filter with the bondwidth approximately 20 MHz and the center frequency $f_0$ of 880 MHz by using the configuration of FIG. 3, the coupling coefficient $K_{ij}$ (suffixes i and j show the i'th dielectric resonator and j'th dielectric resonator from the input side, respectively) is as follows: $K_{12}=K_{56}=2.774\times10^{-2}$, $K_{23}=K_{45}=1.921\times10^{-2}$ and $K_{34}=1.7827\times10^{-2}$. Thus, the pitch $P_{ij}$ is selected as follows: $P_{12}\approx P_{56}\approx6.9$ mm, $P_{23}\approx P_{34}\approx7.2$ mm and $P_{34}\approx7.3$ mm.

Figure 8:
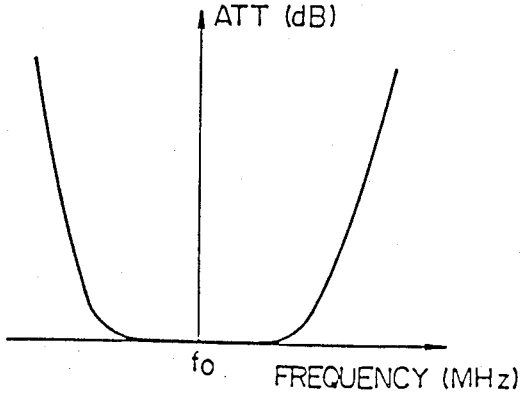
FIG. 8 shows the variation of the attenuation of the input signal as a function of the frequency in the filter of FIG. 3.

FIG. 8 shows the filter response characteristics thus designed.

Figure 9:
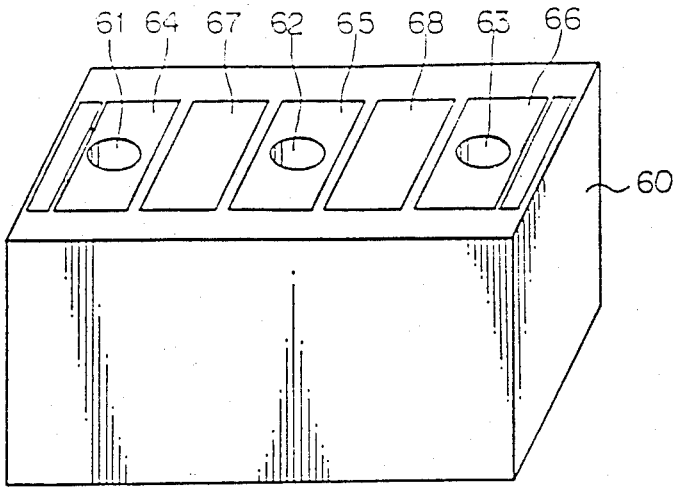
FIG. 9 is a perspective view of another microwave filter according to the present invention.

FIG. 9 is a perspective view of another microwave filter embodying the present invention. In this figure, the reference numeral 60 is a dielectric block, 61, 62 and 63 are plated holes and 64, 65 and 66 are conductive areas, those elements themselves have the similar configurations as elements shown in FIG. 3. The feature of the filter of FIG. 9 compared with the filter of FIG. 3 is that on the surface of the block 60, there are provided a conductive area 67 between the areas 64 and 65 and a conductive area 68 between the areas 65 and 66. Considering an equivalent circuit of this filter, each of the conductive areas 67, 68 acts as a capacitor coupling adjacent dielectric resonators with each other (each of which can be considered as the combination of an inductor and a capacitor in parallel). Of course, in the filter of FIG. 3, the areas between adjacent conductive areas 39–44 act as a reactor in the equivalent circuit. On the other hand, the configuration of FIG. 9 can provide a large capacitance as compared with that of the configuration of FIG. 3. The capacitance resulting from the presence of each of the conductive areas 67, 68 is adjustable by varing the area thereof by means of a mechanical manner or an optical manner. Furthermore, the pattern of each of the conductive areas 67, 68 is not limited to the rectangular shape and any shape of the pattern can be selected.

Figure 10:
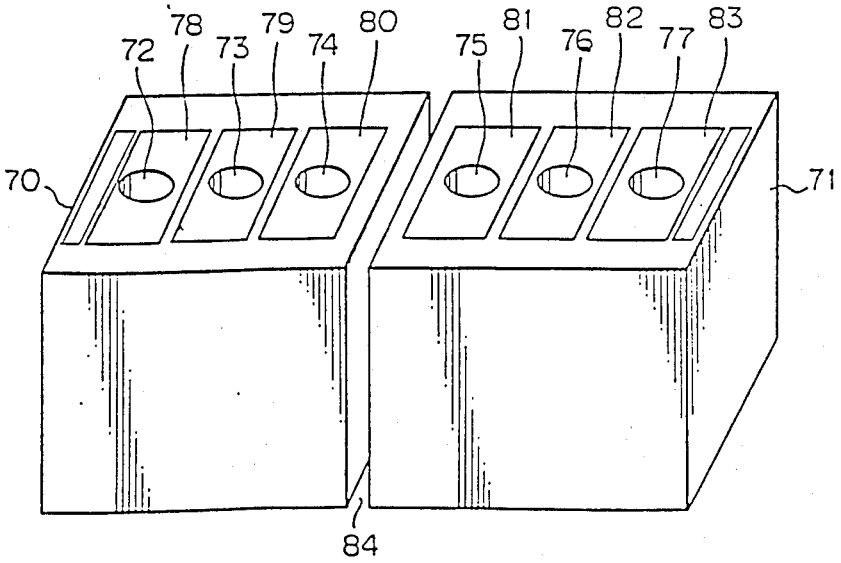
FIG. 10 is a perspective view of still another microwave filter according to the present invention.

FIG. 10 is a perspective view of still another microwave filter embodying the present invention. In this figure, the reference numerals 70 and 71 are dielectric blocks, 72 through 77 are plated holes and 78 through 83 are conductive areas, those elements themselves having the similar configurations as elements shown in FIG. 3. The feature of this configuration is that two blocks 70 and 71 each having three dielectric resonators are aligned across a spacing 84, in other words the filter is composed of individual dielectric blocks. In this arrangement, two opposite side surfaces through the spacing 84 are not metallized. This spacing 84 acts as an electromagnetic coupler for coupling the dielectric resonator having the plated holes 74 with the dielectric resonator having the plated holes 75. In view of the equivalent circuit of the filter thus configurated, the spacing operates as a capacitor coupling those dielectric resonators with each other. The amount of the coupling which the spacing 84 provides depends upon the length thereof. Of course, it is possible to apply the beforementioned feature shown in FIG. 9 to the configuration of FIG. 10. Furthemore, any number of dielectric blocks can be selected.

The configuration of FIG. 10 has the following advantage compared with that of FIG. 3. A positioning error in the pitch between adjacent holes upon the producing operation of holes brings about an error in the coupling coefficient, and thus the filter having the desired filter response characteristics can not be obtained. For instance, when a filter is composed of six dielectric resonators (in the case of FIG. 3 or FIG. 10), only three holes are formed in one dielectric block in accordance with the configuration of FIG. 10, while six holes are formed in one dielectric block in accordance with the configuration of FIG. 3. Therefore, it will be understood that the error in the pitch in the configuration of FIG. 10 may be smaller than that in the configuration of FIG. 3.

From the foregoing, it will now be apparent that a new and improved microwave filter has been discovered. It should be understood of course that the embodiments disclosed are merely illustrative and are not intended to limit the scope of the invention. Reference should be made to the appended claims, therefore, rather than the specification as indicating the scope of the invention.

We claim:

1. A microwave filter having an input means and an output means therein, comprising:

a rectangular solid-shaped dielectric block having a plurality of parallel holes extending from the top surface to the bottom surface thereof, the interior surfaces of said holes being covered with a conductive material;

conductive flat areas provided relative to all the respective holes and spatially disposed on said top surface of said dielectric block to surround the opening ends of said holes, each of said conductive flat areas being connected with said conductive material of a corresponding hole and having a configuration that is adjustable;

a conductive layer provided on the bottom surface of said block for electrically connecting all the conductive materials of said holes together; and at least one further conductive area disposed on said top surface of said dielectric block between adjacent conductive flat areas associated with said holes, the at least one further conductive area having a configuration that is adjustable, whereby the characteristic of the filter is adjustable by means of selecting the configuration of the conductive flat areas or said at last one further conductive area.

2. A microwave filter according to claim 1, wherein the shape of the each conductive flat areas and of said at least one further conductive area is substantially rectangular.

3. A microwave filter according to claim 1, wherein the conductive flat areas or the at least one further conductive area are trimmed areas which have been trimmed to adjust the characteristic of the filter.

4. A microwave filter comprising:

a rectangular dielectric block having a plurality of parallel holes extending from the top surface to the bottom surface thereof, the interior surfaces of said holes being covered with a conductive material;

conductive flat areas provided relative to all the respective holes and spatially disposed on said top surface of said dielectric block to surround the opening ends of said holes, each of said conductive flat areas being connected with said conductive material of a corresponding hole and having a configuration that is adjustable;

a conductive layer provided on the bottom surface of said block for electrically connecting all the conductive materials of said holes together; and at least one further conductive area disposed on said top surface of said dielectric block between adjacent conductive flat areas associated with said holes, the at least one further conductive area having a configuration that is adjustable;

whereby the characteristic of the filter is adjustable, by means of selecting the configuration of the conductive flat areas or said at least one further conductive area.

5. A microwave filter according to claim 4, wherein the shape of the each conductive flat areas and of said at least one further conductive area is substantially rectangular.

6. A microwave filter according to claim 4, wherein the conductive flat areas or the at least one further conductive area are trimmed areas which have been trimmed to adjust the characteristic of the filter.

7. A microwave filter having an input means and an output means therein, comprising:

a plurality of rectangular dielectric blocks each having a plurality of parallel holes extending from the top surface to the bottom surface thereof, the interior surfaces of said holes being covered with a conductive material;

conductive flat areas provided relative to all the respective holes of each block and spatially disposed on said top surface of each of said dielectric blocks to surround opening ends of said holes, each of said conductive areas being connected with said conductive material of a corresponding hole and having a configuration that is adjustable;

a conductive layer provided on the bottom surface of each block for electrically connecting all the conductive materials of said holes together;

at least one further conductive area disposed on said top surface of each of said blocks between adjacent conductive flat areas associated with said holes; and said dielectric blocks being spatially arranged so that holes of each of said dielectric blocks are aligned;

whereby the characteristic of the filter is adjustable by means of selecting the configuration of the conductive flat areas or said at least one further conductive area.

8. A microwave filter according to claim 7, wherein the shape of the each conductive flat areas and of said at least one further conductive area is substantially rectangular.

9. A microwave filter according to claim 7, wherein the conductive flat areas or the at least one further conductive area are trimmed areas which have been trimmed to adjust the characteristic of the filter.

* * * * *